US006271820B1

(12) United States Patent
Bock et al.

(10) Patent No.: US 6,271,820 B1
(45) Date of Patent: Aug. 7, 2001

(54) LIGHT MODULATING DEVICES

(76) Inventors: Harald Reinhart Bock, 54 Howard Street, Oxford, OX4 3BE; Paul Bonnett, 99 Pheasant Walk, Littlemore, Oxford, OX4 4XX; Michael John Towler, 20 The Garth, Botley, Oxford, OX2 9AL; Diana Cynthia Ulrich, 100A Divinity Road, Oxford, OX4 1LN, all of (GB); Akira Tagawa, 5-3-32, Asahi-cho Kashiwa-shi Chiba 277-0852 (JP)

( * ) Notice: Subject to any disclaimer, the term of this patent is extended or adjusted under 35 U.S.C. 154(b) by 0 days.

(21) Appl. No.: 09/080,164

(22) Filed: May 15, 1998

(30) Foreign Application Priority Data

May 20, 1997 (GB) ..... 9710403

(51) Int. Cl.[7] ..... G06G 3/36
(52) U.S. Cl. ..... 345/97; 345/89
(58) Field of Search ..... 345/97, 95, 30, 345/103, 149, 204, 147, 148, 89, 87; 349/33

(56) References Cited

U.S. PATENT DOCUMENTS

| | | | | |
|---|---|---|---|---|
| 3,937,878 | * | 2/1976 | Judice | 178/7.3 D |
| 4,320,418 | * | 3/1982 | Pavliscak | 358/240 |
| 4,808,991 | * | 2/1989 | Tachiuchi et al. | 340/793 |
| 5,053,764 | * | 10/1991 | Barbier et al. | 340/793 |
| 5,216,417 | | 6/1993 | Honda | 340/793 |
| 5,526,021 | * | 6/1996 | Naylor, Jr. | 345/149 |
| 5,703,621 | * | 12/1997 | Martin et al. | 345/147 |
| 5,739,808 | * | 4/1998 | Suga et al. | 345/147 |
| 5,757,347 | * | 5/1998 | Han | 345/88 |
| 5,905,482 | * | 5/1999 | Hughes et al. | 345/89 |
| 6,040,808 | * | 3/2000 | Knox et al. | 345/13 |
| 6,094,187 | * | 7/2000 | Jones et al. | 345/147 |
| 6,104,365 | * | 8/2000 | Towler et al. | 345/89 |

FOREIGN PATENT DOCUMENTS

| | | |
|---|---|---|
| 03189622 | 8/1991 | (JP) . |
| 05027719 | 2/1993 | (JP) . |
| 05027720 | 2/1993 | (JP) . |
| 08050278 | 2/1996 | (JP) . |

OTHER PUBLICATIONS

Search Report for Application No. GB 9710403.8; Dated Aug. 12, 1997.

* cited by examiner

*Primary Examiner*—Bipin Shalwala
*Assistant Examiner*—Vanel Frenel
(74) *Attorney, Agent, or Firm*—Renner, Otto, Boisselle & Sklar

(57) ABSTRACT

A light modulating device comprises a plurality of data electrodes, a plurality of strobe electrodes, pixels at the intersections of the strobe and data electrodes, and addressing means for supplying data signals to the data electrodes in successive data selection periods and for supplying strobe signals to the strobe electrodes to set the transmission levels of the pixels in dependence on the data signals supplied to the pixels during each data selection period. Each pixel comprises a pair of subelements, and the addressing means is arranged to address the subelements of the pair by 1:3 spatial dither and to supply different strobe signals to each of the subelements during different bits of 1:1 spatial or temporal dither within the same data selection period. The transmission level of each subelement is determined by the data signal applied to the subelement in the data selection period in association with the strobe signal applied to the corresponding spatial or temporal dither bit.

16 Claims, 10 Drawing Sheets

$Vc = \sqrt{2}\ Vd$

FIG.8(a)

(0)

| | |
|---|---|
| b | b |
| b | b |

x y A B

FIG.8(b)

(1)

| | |
|---|---|
| b | b |
| w | b |

FIG.8(c)

(2)

| | |
|---|---|
| w | b |
| w | b |

FIG.8(d)

(3)

| | |
|---|---|
| b | b |
| b | w |

FIG.8(e)

(4)

| | |
|---|---|
| b | b |
| w | w |

FIG.8(f)

(5)

| | |
|---|---|
| w | b |
| w | w |

FIG.8(g)

(6)

| | |
|---|---|
| b | w |
| b | w |

FIG.8(h)

(7)

| | |
|---|---|
| b | w |
| w | w |

FIG.8(i)

(8)

| | |
|---|---|
| w | w |
| w | w |

e.g. N=20 or >21

LIGHT MODULATING DEVICES

FIELD OF THE INVENTION

This invention relates to light modulating devices, and is concerned more particularly, but not exclusively, with ferroelectric liquid crystal display devices and optical shutter devices.

BACKGROUND OF THE INVENTION

It should be understood that the term "light modulating devices" is used in this specification to encompass both light transmissive modulators, such as diffractive spatial modulators, and light emissive modulators, such as conventional liquid crystal displays.

Ferroelectric liquid crystal displays (FLCD's) are considered as suitable candidates for large sized high content display panels, for use in high definition television (HDTV), since they have characteristics, such as memory effect characteristics, fast response time and wide viewing angle, which make them attractive for such applications.

HDTV displays typically require approximately 1,000 scanning lines, all the lines being scanned sequentially within a short frame time to allow frame repetition rates of the order of 70 frames per second. Although FLCD's have much faster response times than conventional nematic liquid crystal displays, ferroelectric liquid crystal (FLC) materials are not always fast enough for 1,000 lines to be scanned within a frame time, and additionally FLC typically exhibits only two stable states corresponding to the black state and the white state, for example. HDTV displays require greyscale, and this may be produced in a number of ways. For example, in the so-called temporal dither (TD) technique, display data is applied to the pixel during two or more consecutive sub-frames within the normal addressing frame time so as to enable the state of the pixel to be separately controlled within each sub-frame, with the result that the temporal average over the whole frame time can represent a grey level between the black and white states. However, because of the increased switching frequency required by such a technique, the number of sub-frames, and hence the number of grey levels obtainable, is restricted by the switching speed of the FLC and/or the power available.

In the so-called spatial dither (SD) technique, which may be used in place of or in addition to TD, the pixel is divided into two or more separately switchable subpixels, which may be of different sizes. The subpixels may each be placed in either the black state or the white state so that the spatial average of the states of the subpixels can represent a grey level between the black and white states. As is well known, the pixels of such a display are commonly addressed by data signals applied to data or column electrodes and strobe signals applied to strobe or row electrodes, which cross the column electrodes so as to define the individual pixels at the intersections of the electrodes, the state of each pixel being determined by the resultant of the data and strobe signals. Furthermore, in the case of a color display, each pixel may be divided into three color subpixels which are generally addressed by splitting each column electrode into three subelectrodes to which separate color data signals are applied. It will be appreciated that the number of subpixels which may be provided for SD or color is restricted by the permissible interconnect density and cost of associated driver circuitry, as well as limitations in the FLC switching speed. In the case of a color display, the restrictions imposed by interconnect density and the driver circuitry are far less stringent for the row electrodes than for the column electrodes since the column electrodes will need to be subdivided to address the color subpixels.

Japanese Patent Publication No. 189622/1991 discloses an arrangement in which each row or strobe electrode is divided into a plurality of subelectrodes which are connected to strobe driver circuitry by resistances of different values such that, for a particular strobe electrode, a subelectrode connected by way of a lower resistance is scanned simultaneously by the same strobe voltage as a subelectrode connected by way of a higher resistance and, due to the difference in these resistances, different voltage drops and/or phase delays are applied so that the effective strobe voltages of the two subelectrodes differ from one another. This technique may be used to decrease the number of drive circuits where the strobe electrodes are divided into subelectrodes, such as in a SD arrangement. However such resistances increase the phase delays to the strobe signals propagated along the electrodes, and consequently a larger line address time (LAT) may be needed in order to ensure switching of the pixels at the remote ends of the electrodes.

Furthermore such an arrangement does not allow fully independent control of the subelectrodes. For example, if such an arrangement is to be used for controlling the states of two subpixels of different sizes for control of grey level by the SD technique, it is only possible to obtain three out of the four possible combinations of states of the two subpixels. The combinations black-black, black-white and white-white are obtainable, whereas the combination white-black is not obtainable. Where the subpixels are of different sizes, this means that one of the possible grey levels is not obtainable.

Japanese Patent Publication No. 50278/1996 discloses a driving scheme for addressing a plurality of electrodes simultaneously. However this driving scheme requires data voltages of different amplitudes, which results in different FLC memory angles in the pixels. Again it is not possible to achieve complete independence of control of those electrodes which are scanned simultaneously in such an arrangement.

Japanese Patent Publications Nos. 27719/1993 and 27720/1993 describe a technique in which each strobe electrode is divided into two subelectrodes which are scanned simultaneously, one of the subelectrodes being first blanked black while the other subelectrode is first blanked white, and the two subelectrodes being scanned with pulses of opposite polarity while data is applied to select the state of each subpixel to obtain the required greyscale. Any local temperature variation has opposite effects in the two subelectrodes tending to cancel the temperature dependence of the grey level. Such a technique allows a substantially error free half analogue grey level to be obtained.

SUMMARY OF THE INVENTION

It is an object of the invention to provide an addressing scheme for a light modulating device, such as an FLCD, which is capable of producing a large number of grey levels.

According to the present invention there is provided a light modulating device comprising a plurality of data electrodes, a plurality of strobe electrodes, modulating elements at the intersections of the strobe and data electrodes, and addressing means for supplying data signals to the data electrodes in successive data selection periods and for supplying strobe signals to the strobe electrodes to set the transmission levels of the elements in dependence on the data signals supplied to the elements during each data selection period, wherein each element comprises a pair of subelements, and the addressing means is arranged to address the subelements of the pair by 1:3 spatial dither and to supply different strobe signals to each of the subelements during different bits of 1:1 spatial or temporal dither within the same data selection period, whereby the transmission level of each subelement is determined by the data signal applied to the subelement in the data selection period in association with the strobe signal applied to the corresponding spatial or temporal dither bit.

Such an arrangement is particularly applicable to display devices in which a suitable number of digital grey levels is difficult to achieve by conventional combined dither techniques because of restrictions on the interconnect density and restrictions on TD due to material speed or power limitations.

Considering the case in which the elements are pixels of an FLCD and each element is divided into four subpixels which are supplied with strobe signals by two row subelectrodes and with data signals by two column subelectrodes, the combination of spatial dither and dual scanning, preferably by application of strobe signals of opposite polarity simultaneously to the row subelectrodes, allows two subpixels located on neighboring row subelectrodes and addressed by a data signal applied to a common column subelectrode to be simultaneously addressed without any increase in the line address time. However, as already indicated above, only three of the four possible combinations of states of the two subpixels can be obtained by such an arrangement due to the fact that only one of the two states white-black and black-white is obtainable. This means that, if such addressing is combined with conventional binary weighted dither, such as 1:2 row spatial dither and 1:4 column spatial dither, the number of grey levels obtainable by the permitted combinations is limited, and in particular a range of linearly spaced grey levels is not obtainable since certain levels will be missing (corresponding to the unobtainable addressing combination referred to above). On the other hand, if the combination of 1:1 row spatial dither and 1:3 column spatial dither is provided, it is possible to produce a range of linearly spaced grey levels without any missing levels.

Preferably each of said different strobe signals is in the form of a strobe pulse which is preceded by a blanking pulse for presetting the subelements to a transmission level determined by the blanking pulse in advance of the application of data signals to the subelements, in which case said different strobe signals may have blanking pulses of opposite polarity for presetting the subelements to different transmission levels during different bits of spatial or temporal dither within the same data selection period.

Furthermore each of the data electrodes will generally comprise two data subelectrodes for separately supplying data signals to the two subelements of each element in the same data selection period.

In one embodiment each of the strobe electrodes comprises two strobe subelectrodes for supplying said different strobe signals to different pairs of subelements of each element to apply spatial dither in the ratio 1:1 in the same data selection period. However, in an alternative embodiment, the addressing means is arranged to supply said different strobe signals to the subelements of each element within different temporal subframes to provide temporal dither in the ratio 1:1 in the same data selection period. For example the addressing means may be arranged to supply said different strobe signals in sequence such that each of the strobe signals is applied to each strobe electrode at the same time as the other strobe signal is applied to an adjacent strobe electrode using an interlacing technique. Such a technique, when used in a display for example, allows dual scanning by the two strobe signals without requiring the addition of extra row electrodes. To achieve this adjacent row electrodes are scanned simultaneously with the two strobe signals but scanning of successive pairs of adjacent row electrodes is interlaced. In other words, following scanning of a pair of electrodes n−1 and n by the two strobe signals, the electrodes n and n+1 are scanned by the strobe signals (with the electrode n being scanned with the strobe signal of opposite polarity to that with which it was scanned in the first scanning frame).

Preferably the addressing means is arranged to supply data signals to the subelements corresponding to three possible data types, namely a data type which sets the subelement to a first state, a data type which sets the subelement to a second state, and an intermediate data type which sets the subelement to a first state or a second state depending on the strobe signal which is applied to the subelement.

In addition the addressing means may be arranged to address the subelements during different successive temporal subframes to provide temporal dither within each addressing frame. For example the addressing means may be arranged to apply temporal dither in the ratio 1:9:N where N is greater than 21, or alternatively in the ratio 1:9:20 with only one of the strobe signals being applied during the most significant subframe (20).

In a development of the invention each of the elements comprises a further subelement in addition to the subelements of said pair, the three subelements having transmission surface areas in the ratio of 1:3:9 and being separately addressable by spatial dither.

BRIEF DESCRIPTION OF THE DRAWINGS

In order that the invention may be more fully understood, a preferred embodiment in accordance with the invention will now be described, by way of example, with reference to the accompanying drawings, in which:

FIGS. 8(*a*) to 8(*i*) diagrammatically illustrate nine possible grey levels obtainable by addressing of the pixel of FIG. 3;

DESCRIPTION OF THE PREFERRED EMBODIMENTS

Figure 1:
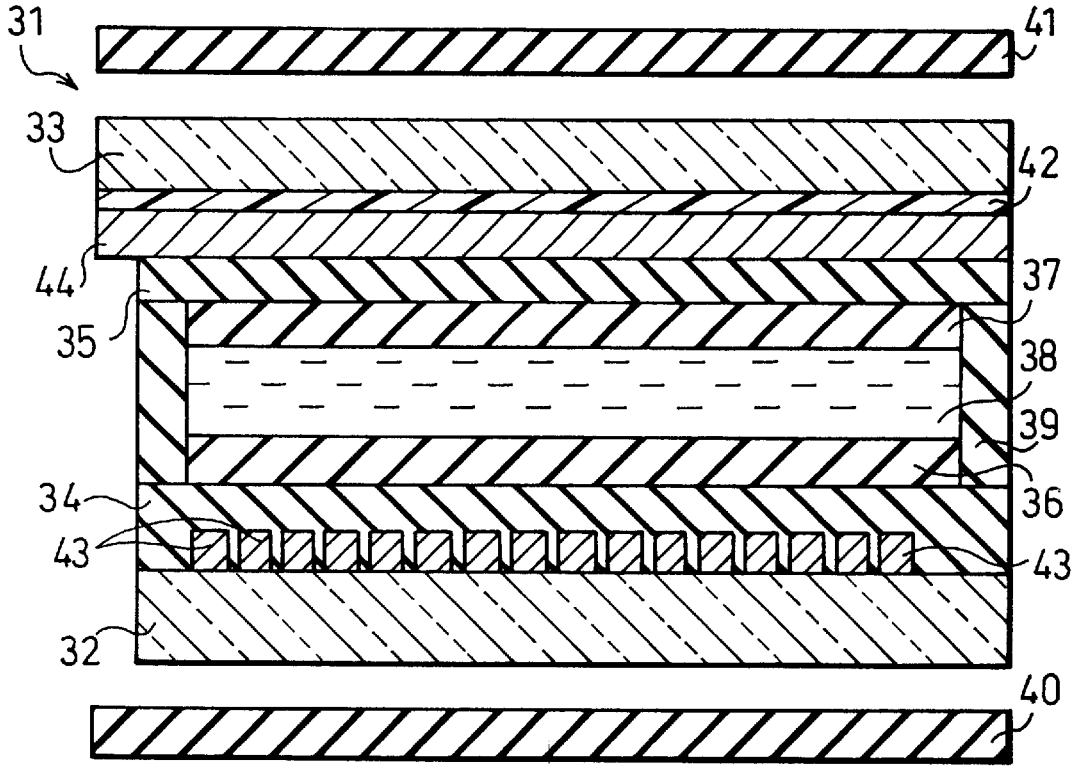
FIG. 1 is a diagrammatic section through a ferroelectric liquid crystal display panel.

The following description will be given with reference to a large ferroelectric liquid crystal display (FLCD) panel 31 shown diagrammatically in FIG. 1. The FLCD panel 31 comprises a layer 38 of ferroelectric smectic liquid crystal material contained between two parallel glass substrates 32 and 33 bearing first and second electrode structures on their inside surfaces, a color filter layer 42 being interposed between the substrate 33 and the corresponding electrode structure. The first and second electrode structures comprise respectively a series of row and column electrodes 43 and 44 of, for example, indium tin oxide which cross one another to form a matrix of modulating elements (pixels) at the intersections of the electrodes 43, 44. Each of the electrode structures is coated with a transparent insulating film 34 or 35 made of silicon oxide ($SiO_2$), for example. Furthermore alignment layers 36 and 37 made of polyvinyl alcohol, for example, are applied on top of the insulating films 34 and 35 so that the alignment layers 36 and 37 contact opposite sides of the ferroelectric liquid crystal layer 38 which is sealed at its edges by a sealing member 39. The panel 31 is disposed between polarisers 40 and 41 having polarizing axes which are substantially perpendicular to one another.

Figure 2:
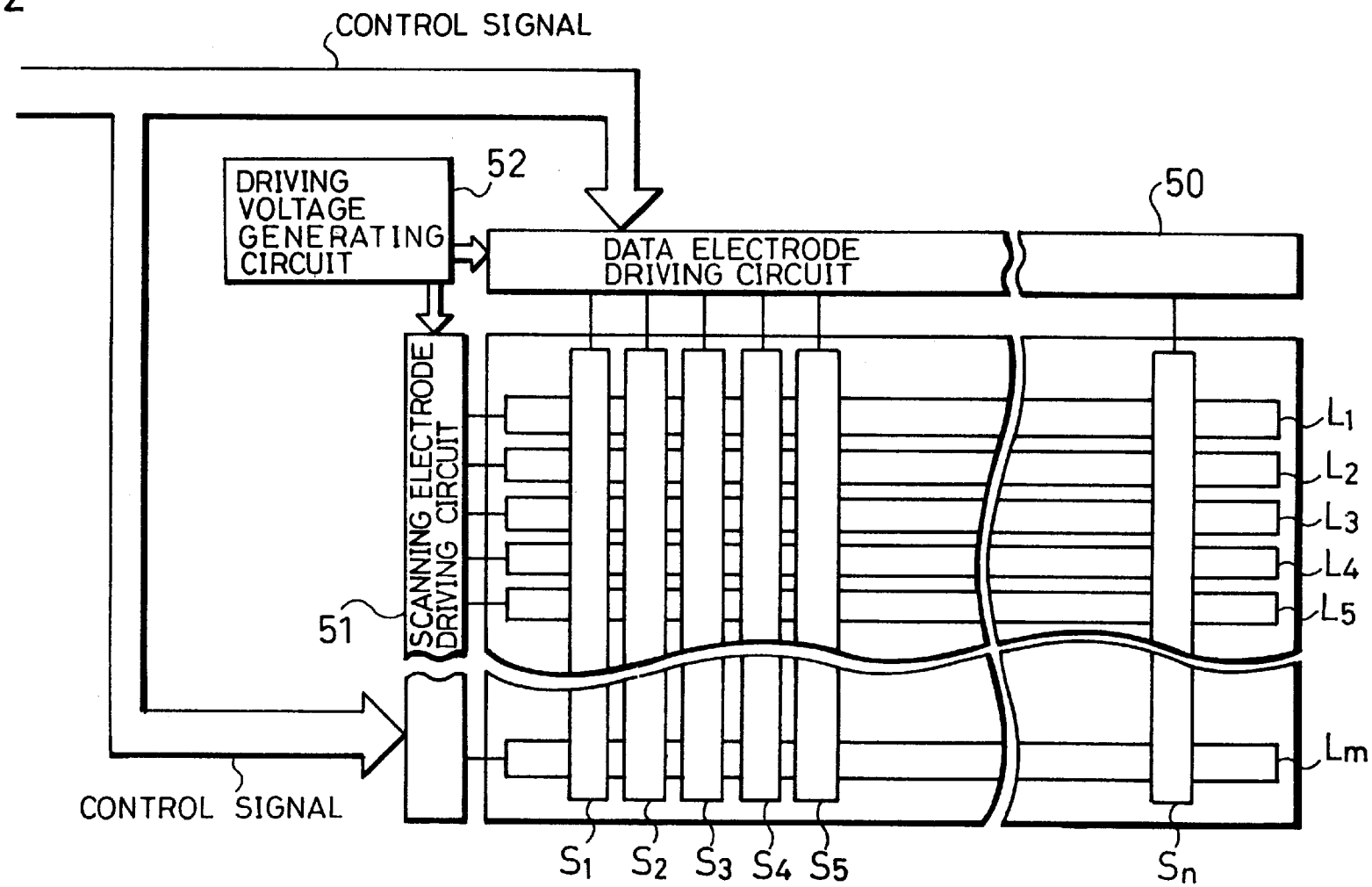
FIG. 2 is a schematic diagram of an addressing arrangement for such a panel.

A known addressing arrangement for such a display panel is shown schematically in FIG. 2 and comprises a data electrode driving circuit 50 coupled to the column electrodes $S_1$, $S_2$, $S_3$, $S_4$, $S_5$, . . . , $S_n$ and a scanning electrode driving circuit 51 coupled to the row electrodes $L_1$, $L_2$, $L_3$, $L_4$, $L_5$, . . . , $L_m$. The addressable pixels formed at the intersections of the column and row electrodes are addressed by data signals supplied by the data electrode driving circuit 50 in association with strobe signals supplied by the scanning electrode driving circuit 51 in response to driving voltages supplied by a driving voltage generating circuit 52 and control signals indicative of the image to be displayed.

Figure 3:
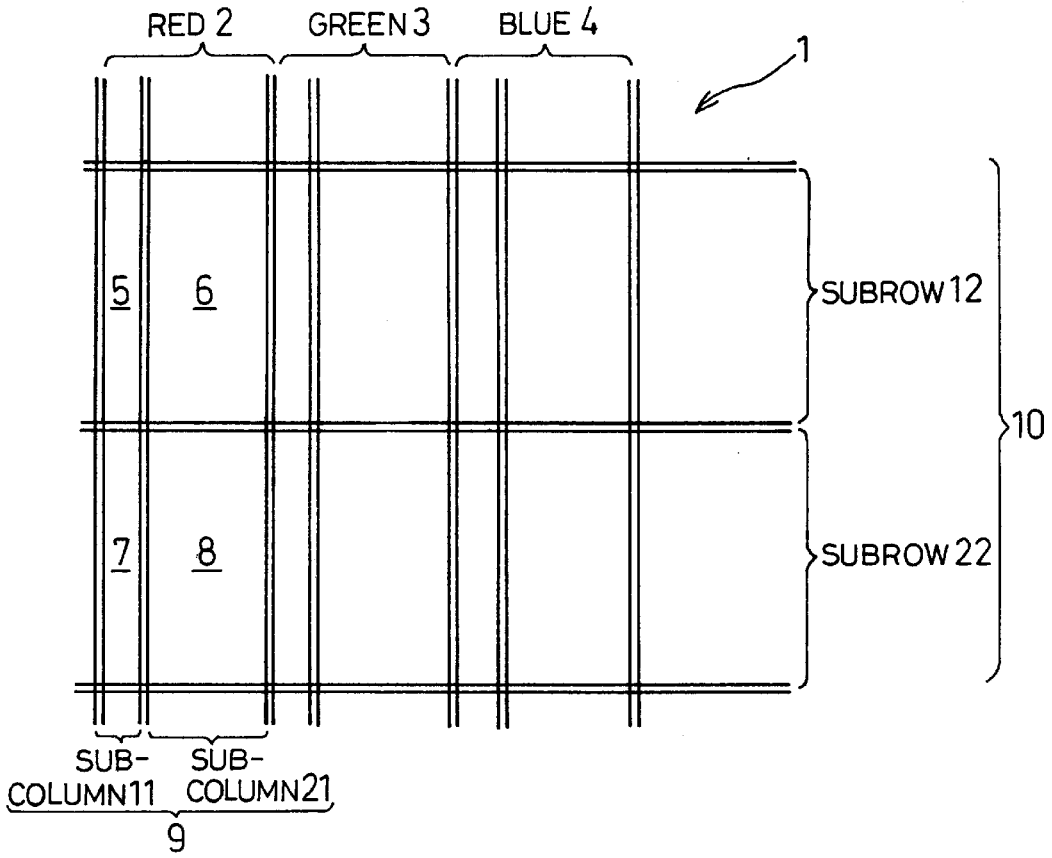
FIG. 3 is an explanatory diagram showing a pixel of a panel in accordance with the invention.

FIG. 3 shows a color pixel 1 of an FLCD divided into three color subpixels 2, 3 and 4 which are in turn each divided into four further subpixels such as 5, 6, 7 and 8 addressed by 1:3 SD of column electrodes 9 and 1:1 SD of row electrodes 10 in accordance with an embodiment of the invention. Thus the ratio of the area of the subpixel 5 to the area of the subpixel 6 and the ratio of the area of the subpixel 7 to the area of the subpixel 8 are 1:3, whereas the ratio of the area of the subpixel 5 to the area of the subpixel 7 and the ratio of the area of the subpixel 6 to the area of the subpixel 8 are 1:1. Furthermore each of the column electrodes 9 comprises subcolumn electrodes 11 and 21 for receiving separate data signals, and each of the row electrodes 10 comprises subrow electrodes 12 and 22 for receiving two strobe signals in order to address the subpixels 5, 6, 7 and 8. It will be appreciated that the subcolumn electrodes 11, 21 and subrow electrodes 12, 22 of the column and row electrodes 9 and 10 are applied to the two substrates between which the FLC material is contained in the general manner described above with reference to the generalized description of an FLCD panel given with reference to FIG. 1, and that the row and column electrodes 9 and 10 cross one another so as to define a plurality of pixels within the FLC material at the intersections of the electrodes, each of which is divided into subpixels as described above. Furthermore, as described with reference to FIG. 2 above, data and scanning electrode driving circuits are connected to the column and row electrodes 9 and 10 in order to apply the strobe and data signals required to control the states of the subpixels 5, 6, 7 and 8 as will be described in more detail below with reference to FIGS. 4 and 5.

Although a color pixel having three color subpixels is shown in FIG. 3 by way of example, it will be understood that the invention is also applicable to a non-color pixel in which case the pixel will not of course be divided into separate color subpixels.

Figure 4:
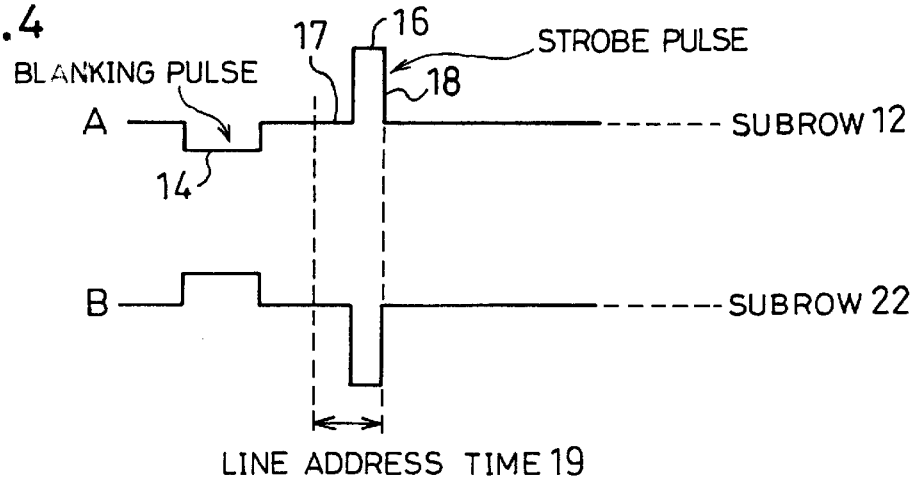
FIGS. 4 and 5 show suitable strobe and data signals for addressing the pixel of FIG. 3.
Figure 5:
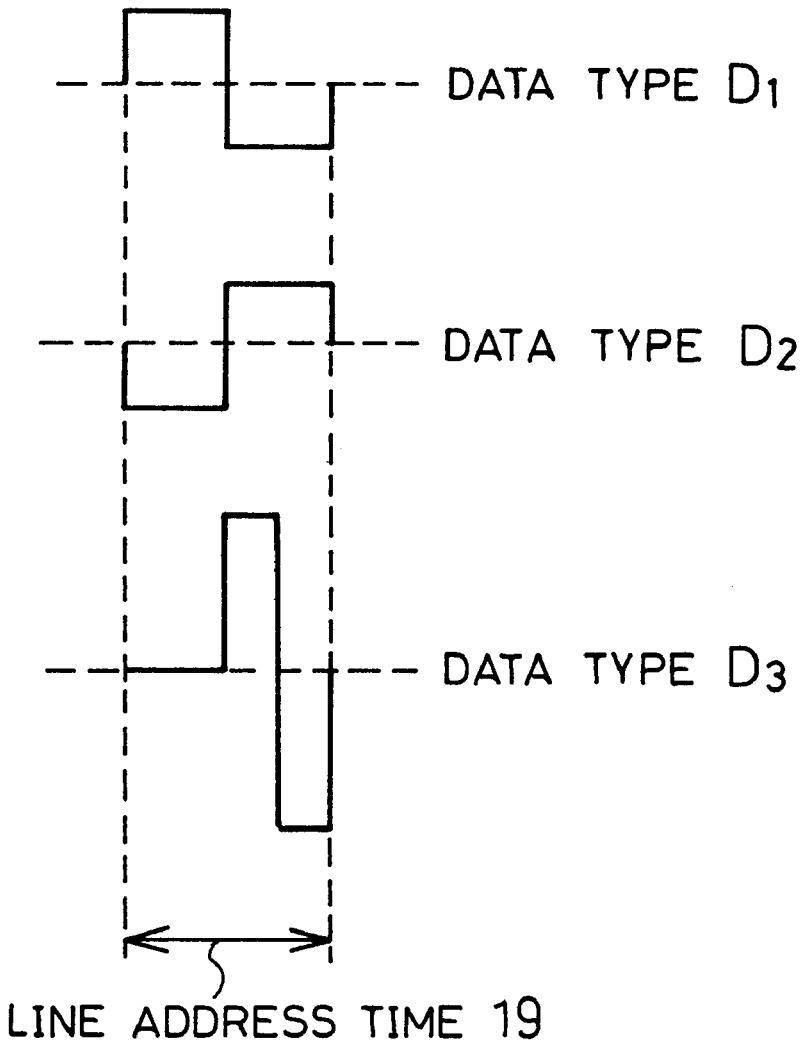

FIGS. 4 and 5 show a possible combination of strobe and data signals which may be applied to the subrow electrodes 12, 22 and the subcolumn electrodes 11, 21 in the preferred embodiment of the invention described. As will be well understood to those skilled in the art, such signals are only examples of signals which may used to control switching of the subpixels 5, 6, 7 and 8 and other combinations of strobe and data signals are contemplated within the scope of the invention. In the case of the subrow electrodes 12, 22, strobe signals A and B of the same form but of opposite polarity are applied simultaneously to the subrow electrode 12 and the subrow electrode 22. Each strobe signal includes a blanking pulse 14 and a strobe pulse 16, the blanking pulse 14 of the strobe signal A being of negative polarity to set the subpixels 5, 6 to the black state in advance of the strobe pulse 16 being received, and the blanking pulse 14 of the strobe signal B being of positive polarity to set the subpixels 7, 8 to the white state in advance of the strobe pulse 16 being received. On receipt of the strobe pulse 16 the pixel is either switched or not switched depending on the polarity of the strobe pulse 16 and the type of data signal applied to the corresponding subcolumn electrode 11 or 21. Each strobe pulse 16 comprises a zero voltage portion 17 followed by a positive or negative voltage portion 18 of the same duration, the total duration of the portions 17 and 18 being the line address time (LAT) 19.

Referring to FIG. 5, the data signal applied to each of the subcolumn electrodes 11 and 21 may be of three different types, namely data type $D_1$ for setting both subpixels 5, 7 or 6, 8 to the black state, data type $D_2$ for setting both subpixels 5, 7 or 6, 8 to the white state, and data type $D_3$ which is an intermediate data type for setting one subpixel to the black state and the other subpixel to the white state of the subpixel pair 5, 7 or 6, 8. Each of the data types $D_1$, $D_2$ and $D_3$ consists of four time slots which together correspond to the LAT 19 during which the strobe pulse 16 of the strobe signal A or B is applied to effect switching or non-switching of the subpixels 5, 6, 7 and 8 during a select period under the effect of the resultant voltage due to simultaneous application of the strobe and data pulses. It will be appreciated that the data types $D_1$, $D_2$ and $D_3$ are different from each other but have some common features. For instance, each data type has no net DC component. This ensures that the liquid crystal material will not deteriorate with time due to ionic effects. Furthermore the three data types have the same RMS voltage. This ensures that the same intensity of transmission is obtained in the non-select period regardless of the data type which is applied. If the RMS voltage were different for the three data types, this would result in slightly different transmission intensities in the white state or in the black state depending on the data type applied.

Figure 6A:
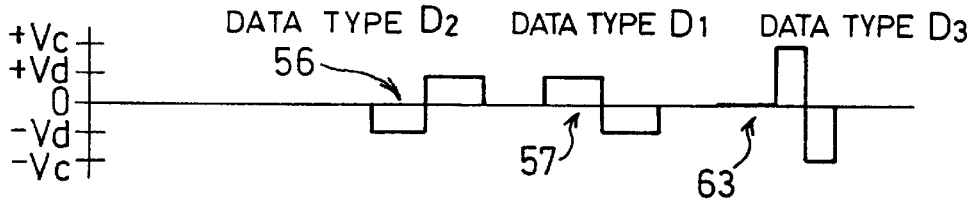
FIGS. 6(*a*) to 6(*c*) are explanatory diagrams showing the resultant voltages obtained by combining of the strobe and data signals of FIGS. 4 and 5.
Figure 6B:
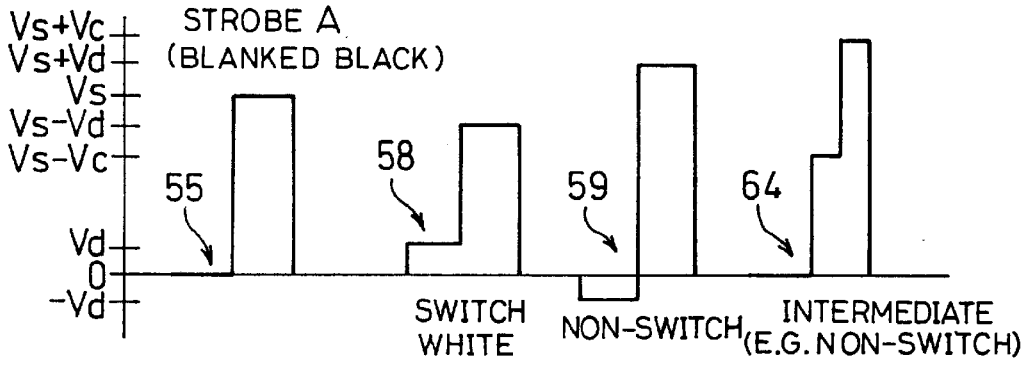
Figure 6C:
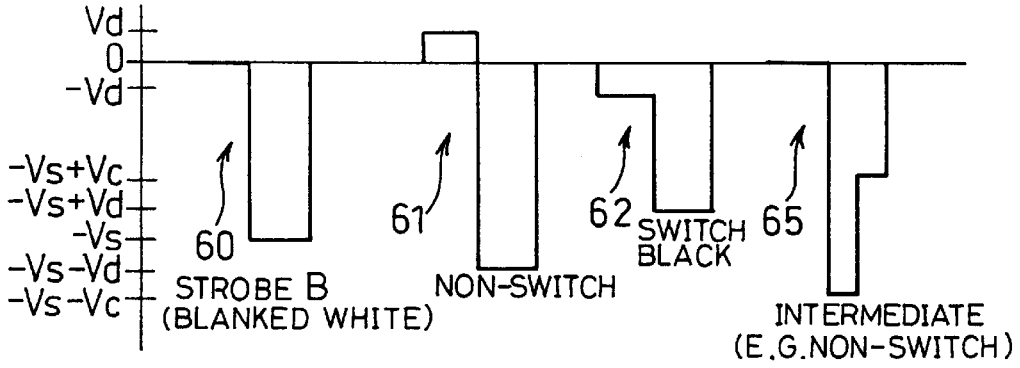

The manner in which the strobe and data signals of FIGS. 4 and 5 are combined to determine the switching state of the subpixels 5, 7 or 6, 8 in response to simultaneous application of the strobe signals A and B to the adjacent subrow electrodes 12, 22 will now be described with reference to FIGS. 6(*a*) to 6(*c*). When the waveform 55 of the strobe signal A incorporating a strobe pulse of voltage $V_s$, is combined with the waveform 56 of data type $D_2$ comprising negative and positive pulses of voltage $-V_d$ and $V_d$ during the select period, the resultant voltage waveform 58 across the pixel is such as to switch the subpixel 5 or 6 from the black state (to which it has previously been blanked by the blanking pulse of the strobe signal A) to the white state. When the waveform 55 of the strobe signal A is combined with the waveform 57 of data type $D_1$ comprising positive and negative pulses of voltage $V_d$ and $-V_d$ during the select period, the resultant voltage waveform 59 does not result in switching of the subpixel 5 or 6 so that the subpixel remains in the black state. On the other hand, when the waveform 60 of the strobe signal B is combined with the waveform 56 of data type $D_2$ during the select period, the resultant voltage waveform 61 does not result in switching of the other subpixel 7 or 8 so that the subpixel remains in the white state (to which the subpixel has previously been blanked by the blanking pulse of the strobe signal B). When the waveform 60 of the strobe signal B is combined with the waveform 57 of data type $D_1$, however, the resultant voltage waveform 62 applied to the subpixel 7 or 8 results in switching of the subpixel from the white state to the black state. Furthermore, when the waveform 55 of the strobe signal A or the waveform 60 of the strobe signal B is combined with the data type $D_3$ having a zero voltage portion followed by positive and negative pulses of voltage $V_c$ and $-V_c$ the resultant voltage waveforms 64 or 65 obtained across the subpixel 5 or 6 or the subpixel 7 or 8 is chosen to have the same effect whether the strobe signal A or the strobe signal B is applied. This effect may be either to cause both of the subpixels 5, 7 or 6, 8 to switch or both of the subpixels not to switch. It is preferred that both of the subpixels should not be switched by the data type $D_3$ in order to minimize the power requirement. In this case, when the waveform 63 of the data type $D_3$ is applied during the select period of the strobe signal A or the strobe signal B, the resultant voltage waveform 64 causes the subpixel 5 or 6 to remain in the black state, or alternatively the resultant voltage waveform 65 causes the subpixel 7 or 8 to remain in the white state.

Figure 7B:
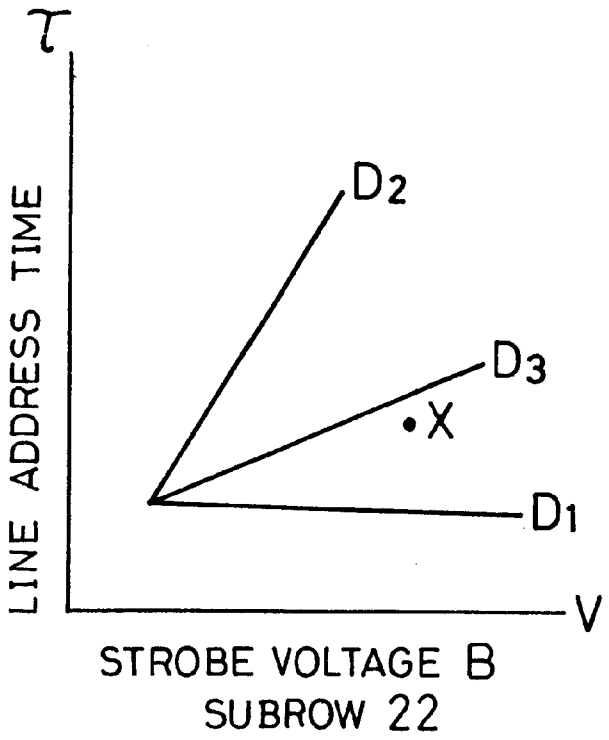
FIGS. 7(*a*) and 7(*b*) show two graphs illustrating the switching characteristics associated with the two strobe signals A and B for three different data types.
Figure 7A:
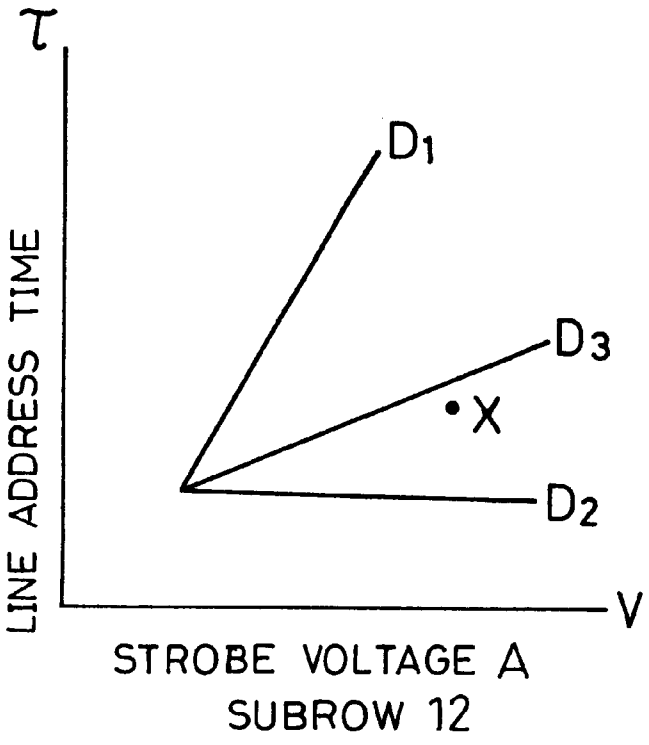

FIGS. 7(*a*) and 7(*b*) diagrammatically shows the simplified τ–V characteristics of the subpixels for the strobe signals A and B showing in each case the voltage V across the subpixel against LAT and the switching/non-switching boundary for each data type $D_1$, $D_2$ and $D_3$. It will be appreciated that in each case the graph is only intended to be illustrative as the actual boundaries will be more complex. In each case the area above each boundary represents the switching of the pixel to the opposite state. Since the strobe signals A and B are inverted relative to one another, the data types $D_1$ and $D_2$ will effect switching or non-switching of a subpixel in dependence on which of the two strobe signals A and B is applied to the subpixel. Thus, in the case of the strobe signal A, assuming a suitable operating point X, the data type $D_2$ will effect switching of the subpixel whereas the data type $D_1$ will not effect switching of the subpixel. In the case of the strobe signal B, on the other hand, the data type $D_2$ will not effect switching of the subpixel whereas the data type $D_1$ will effect switching of the subpixel. The data type $D_3$ can be chosen either to effect switching or not to effect switching in both cases, and it will be appreciated that, in either alternative, one of the two subpixels will be set to the white state and the other subpixel will be set to the black state (and the possibility will not exist of setting the one subpixel to the black state and the other subpixel to the white state).

FIGS. 8(*a*) to 8(*i*) show diagrammatically the switching of the subpixels 5, 6, 7 and 8 by different combinations of the strobe and data signals assuming a suitable operating point X as described above in order to obtain the nine different grey levels. In each case the strobe signals A and B are applied to the subrow electrodes 12 and 22 while data signals x and y corresponding to any of the three data types are applied to the subcolumn electrodes 11 and 21 , and the grey levels obtained can be characterized by the corresponding pairs of data types applied to the subcolumn electrodes 11, 21, as follows:

| LEVEL | DATA SIGNAL TO SUBCOLUMN 11 | DATA SIGNAL TO SUBCOLUMN 21 | RATIO OF WHITE STATE TO TOTAL PIXEL AREA |
|---|---|---|---|
| (0) | $D_1$ | $D_1$ | 0:8 |
| (1) | $D_3$ | $D_1$ | 1:8 |
| (2) | $D_2$ | $D_1$ | 2:8 |
| (3) | $D_1$ | $D_3$ | 3:8 |
| (4) | $D_3$ | $D_3$ | 4:8 |
| (5) | $D_2$ | $D_3$ | 5:8 |
| (6) | $D_1$ | $D_2$ | 6:8 |
| (7) | $D_3$ | $D_2$ | 7:8 |
| (8) | $D_2$ | $D_2$ | 8:8 |

It will be appreciated from this diagram that data type D, results in both of the subpixels 5, 7 or 6, 8 addressed by the data signal applied to the subcolumn electrode 11 or the subcolumn electrode 21 being in the black state b, data type $D_2$ results in both of the subpixels 5, 7 or 6, 8 addressed by the data signal applied to the subcolumn electrode 11 or the subcolumn electrode 21 being in the white state w, and data type $D_3$ results in only one of the subpixels 5, 7 or 6, 8 addressed by the data signal applied to the subcolumn electrode 11 or the subcolumn electrode 21 being in the black state b, that is in the subpixel 5 or 6 addressed by the strobe signal A applied to the subrow electrode 12 being in the black state b, while the subpixel 7 or 8 addressed by the strobe signal B applied to the subrow electrode 22 is in the white state w. Thus the combination of 1:3 SD applied to the column electrodes and 1:1 SD applied to the row electrodes enables nine linearly spaced grey levels (0) to (8) to be obtained.

Figure 9A:
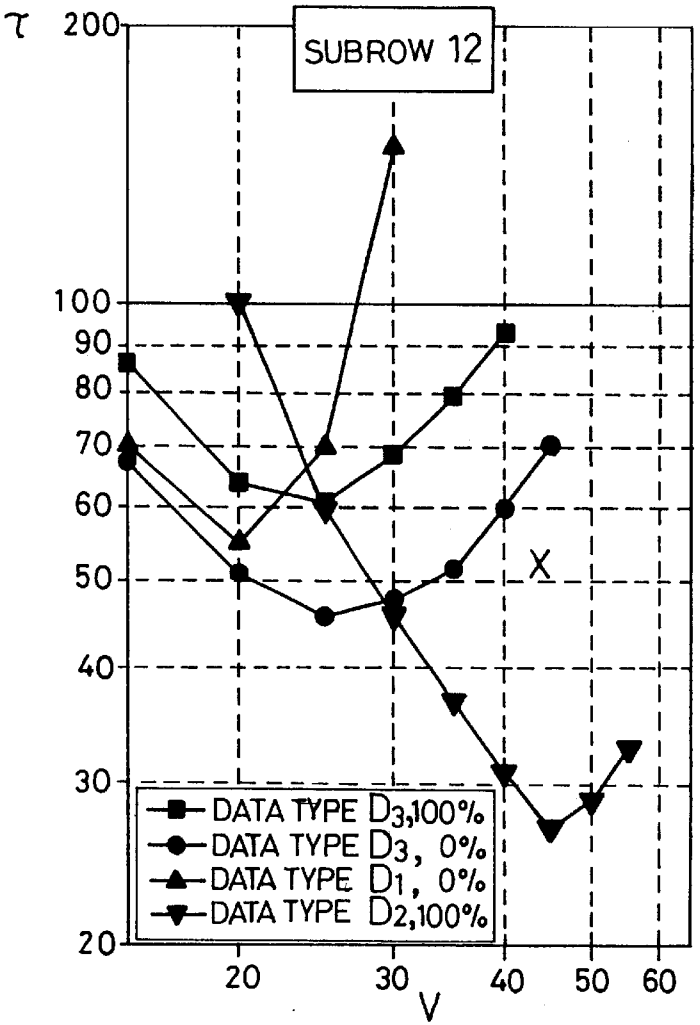
FIGS. 9(*a*) and 9(*b*) show typical τ−V characteristics associated with the two strobe signals of FIG. 4 for the data types shown in FIG. 5.
Figure 9B:
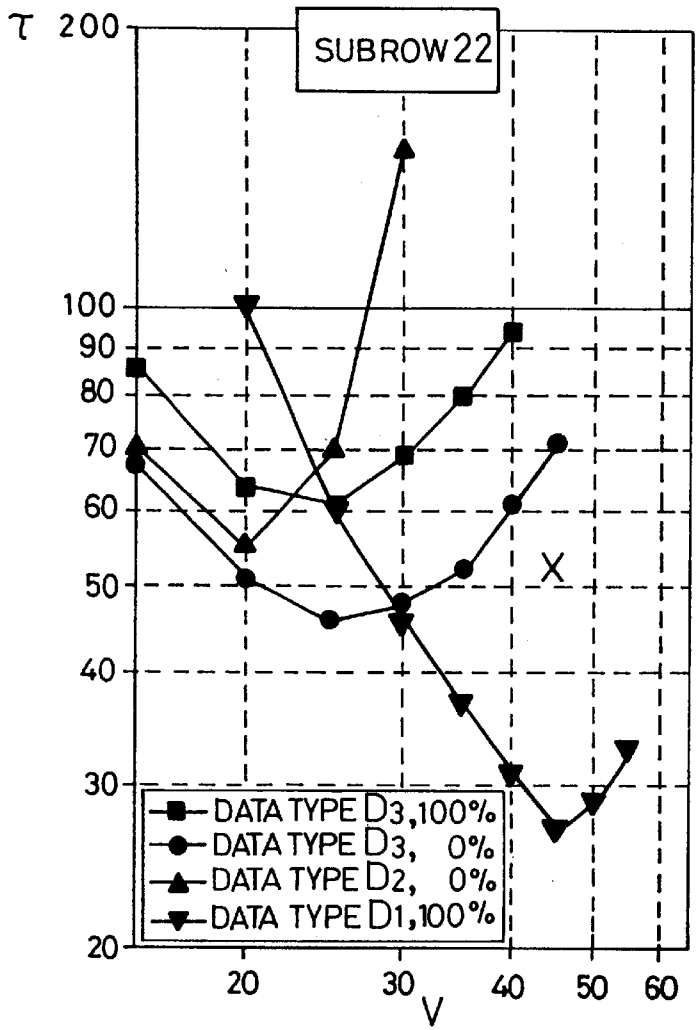

FIGS. 9 (*a*) and 9 (*b*) show the τ–V characteristics of the FLC material SCE8 (which is a material which is commercially available from Hoechst AG) obtained experimentally with the strobe signal A applied to the subrow electrode 12 (FIG. 9(*a*)) and the strobe signal B applied to the subrow electrode 22 (FIG. 9(*b*)). The characteristics were measured at a temperature of 25 degrees C. and at a data voltage of 8V RMS. In the case of the subrow electrode 12, there is shown the non-switching curve (0% of material switched) of data type $D_1$, the switching curve (100% of material switched) of data type $D_2$ and both the switching curve (100% of material switched) and the non-switching curve (0% of material switched) of data type $D_3$. In the case of the subrow electrode 22, there is shown the switching curve (100% of material switched) of data type $D_1$, the non-switching curve (0% of material switched) of data type $D_2$ and both the switching curve (100% of material switched) and the non-switching curve (0% of material switched) of data type $D_3$.

Figure 10:
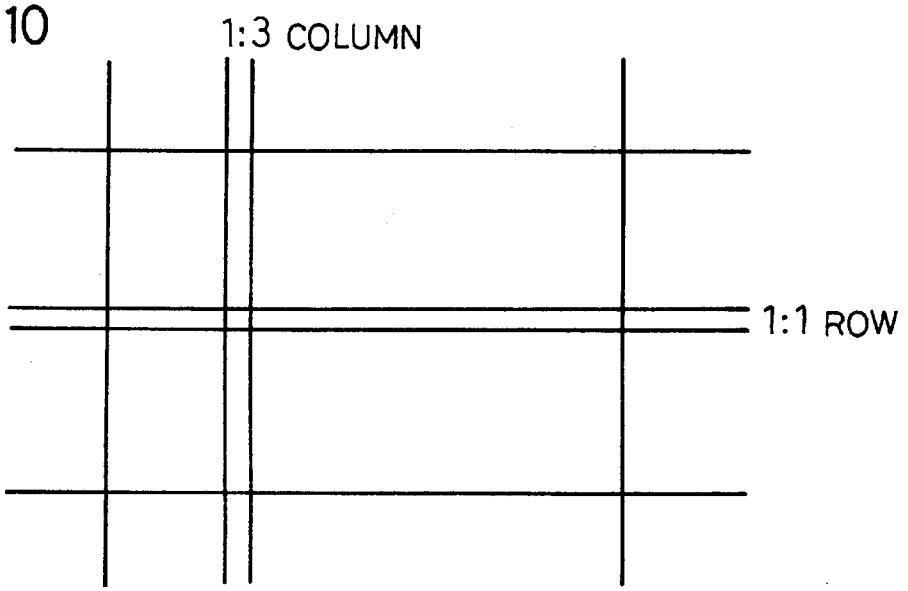
FIGS. 10, 11, 12 and 13 are explanatory diagrams illustrating alternative embodiments of the invention.
Figure 11:
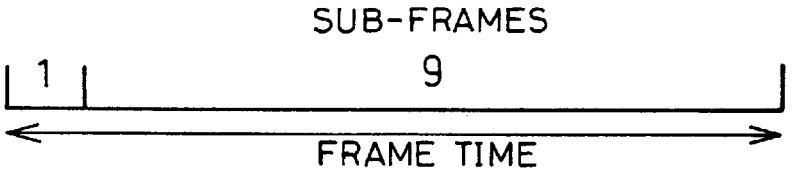

The above described embodiment utilizes 1:3 column and 1:1 row SD, as shown diagrammatically in FIG. 10, in combination with an inverted dual scanning scheme in which strobe signals A and B, which are inverted relative to one another, are applied simultaneously to the subrow electrodes, but in which TD is not applied. In a variant of this embodiment the same combination of SD and inverted dual scanning is provided, but with the addition of TD in which each addressing frame is divided into two subframes of relative duration 1:9 in which different data signals may be applied, as shown diagrammatically in FIG. 11. The different data signals applied during the two subframes are combined with appropriately timed strobe signals applied to the subrow electrodes so as to define two select periods in the ratio 1:9 during each of which the subpixel can be switched to the black state or the white state. The perceived overall grey level within the frame is the temporal average of the transmission levels within the two subframes defined by the select periods, and thus the number of grey levels obtainable can be increased by applying different data signals during these subframes. Such TD can multiply the number of grey levels obtainable by 9 so that a total of 81 linearly spaced grey levels are obtained.

Figure 12:
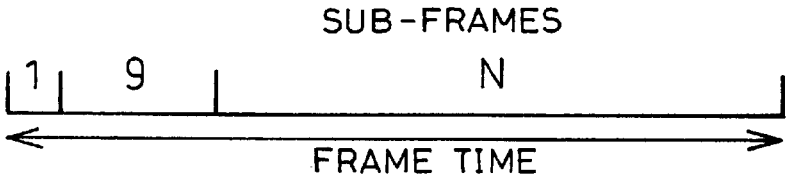

In a further development of this embodiment 3-bit TD may be applied to obtain 256 linearly spaced grey levels by dividing each frame into three separately addressable subframes of relative duration 1:9:N where N is an integer greater than 21, as shown diagrammatically in FIG. 12.

Alternatively such 3-bit TD may be applied in the ratio 1:9:20 in order to decrease the effect of the disadvantageous feature of dither combined with inverted dual scanning which requires that half the rows must be blanked to the white state during all of the subframes, thus reducing the contrast ratio. By using the TD ratio of 1:9:20, it is possible for 241 linearly spaced grey levels to be obtained without the subframe of longest duration having to be addressed using the inverted dual scanning scheme, thus allowing some contrast to be recovered. This means that, in the subframe of longest duration only the two combinations of both subpixels 5, 7 or 6, 8 being switched to the black state b or both subpixels remaining in the white state w are available.

Figure 13:
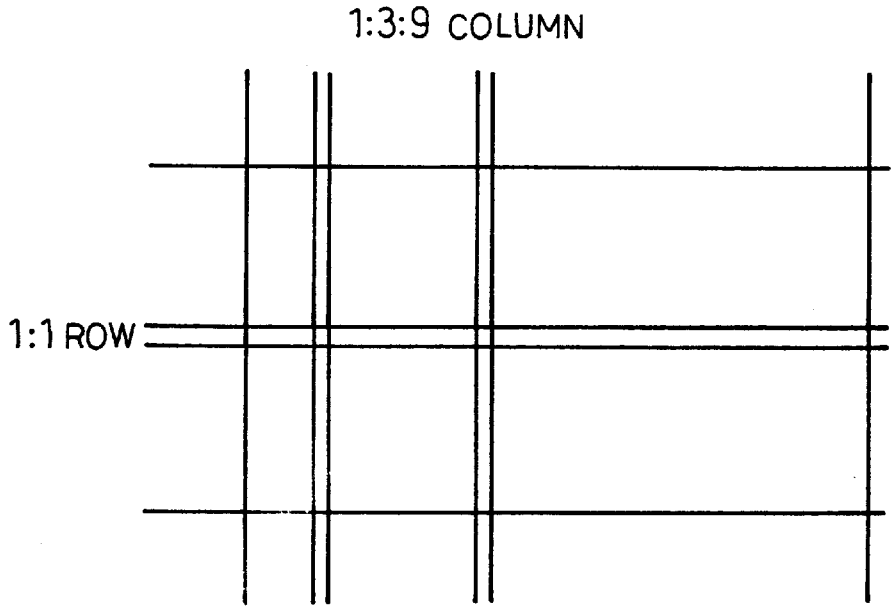

In a further embodiment (in which TD may or may not be provided) 1:3:9 column SD and 1:1 row SD are combined with the inverted dual scanning scheme in order to increase the number of linearly spaced grey levels obtainable, as shown diagrammatically in FIG. 13.

It will be appreciated that temporal and spatial dither techniques may be used individually or in combination to obtain perceived digital grey levels corresponding to the temporal average of the transmission states of subpixels during two or more subframes (in the case of TD) or the spatial average of the transmission levels of two or more subpixels arranged adjacent to one another and having different data signals applied simultaneously thereto (in the case of SD). Although each of the above described embodiments comprises column SD combined with 1:1 row SD, it should be appreciated that the 1:1 row SD could be replaced by 1:1 TD in which different strobe signals are applied in the two subframes. Thus the invention resides in the combination of 1:3 spatial dither applied to a pair of subelements (subpixels) in combination with the application of different strobe signals to each of the subelements during different bits of 1:1 spatial or temporal dither within the same select period.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light modulating device comprising a plurality of data electrodes, a plurality of strobe electrodes, modulating elements at the intersections of the strobe and data electrodes, and addressing means for supplying data signals to the data electrodes in successive data selection periods and for supplying strobe signals to the strobe electrodes to set the transmission levels of the elements in dependence on the data signals supplied to the elements during each data selection period, wherein each element comprises a pair of subelements, and the addressing means is arranged to address the subelements of the pair by 1:3 spatial dither and to supply different strobe signals to each of the subelements during different bits of 1:1 spatial or temporal dither within the same data selection period, whereby the transmission level of each subelement is determined by the data signal applied to the subelement in the data selection period in association with the strobe signal applied to the corresponding spatial or temporal dither bit.

2. A light modulating device according to claim 1, wherein each of said different strobe signals is in the form of a strobe pulse which is preceded by a blanking pulse for presetting the subelements to a transmission level determined by the blanking pulse in advance of the application of data signals to the subelements.

3. A light modulating device according to claim 2, wherein said different strobe signals have blanking pulses of opposite polarity for presetting the subelements to different transmission levels within the same data selection period.

4. A light modulating device according to claim 1, wherein said different strobe signals are of opposite polarity.

5. A light modulating device according to claim 4, wherein said different strobe signals are of the same amplitude.

6. A light modulating device according to claim 1, wherein each of the data electrodes comprises two data subelectrodes for separately supplying data signals to the two subelements of each element in the same data selection period.

7. A light modulating device according to claim 1, wherein each of the strobe electrodes comprises two strobe subelectrodes for supplying said different strobe signals to different pairs of subelements of each element to apply spatial dither in the ratio 1:1 in the same data selection period.

8. A light modulating device according to claim 1, wherein the addressing means is arranged to supply said different strobe signals to the subelements of each element within different temporal subframes to apply temporal dither in the ratio 1:1 in the same data selection period.

9. A light modulating device according to claim 8, wherein the addressing means is arranged to supply said different strobe signals in sequence such that each of the strobe signals is applied to each strobe electrode at the same time as the other strobe signal is applied to an adjacent strobe electrode using an interlacing technique.

10. A light modulating device according to claim 1, wherein the addressing means is arranged to supply data signals to the subelements corresponding to three possible data types, namely a data type which sets the subelement to a first state, a data type which sets the subelement to a second state, and an intermediate data type which sets the subelement to a first state or a second state depending on the strobe signal which is applied to the subelement.

11. A light modulating device according to claim 1, wherein the addressing means is further arranged to address the subelements during different successive temporal subframes to provide temporal dither within each addressing frame.

12. A light modulating device according to claim 11, wherein the addressing means is arranged to apply temporal dither in the ratio 1:9:N where N>21.

13. A light modulating device according to claim 11, wherein the addressing means is arranged to apply temporal dither in the ratio 1:9:20 and, during the most significant subframe, only one of the strobe signals is applied.

14. A light modulating device according to claim 1, wherein each of the elements comprises a further subelement in addition to the subelements of said pair, the three subelements having transmission surface areas in the ratio of 1:3:9 and being separately addressable by spatial dither.

15. A light modulating device according to claim 1, which is a ferroelectric liquid crystal device.

16. A light modulating device comprising a plurality of data electrodes, a plurality of strobe electrodes, modulating elements at the intersections of the strobe and data electrodes, and addressing means for supplying data signals to the data electrodes in successive data selection periods and for supplying strobe signals to the strobe electrodes to set the transmission levels of the elements in dependence on the data signals supplied to the elements during each data selection period, wherein each element comprises a pair of subelements, and the addressing means is arranged to address the subelements of the pair by 1:3 spatial dither and to supply different strobe signals simultaneously to each of the subelements during different bits of 1:1 spatial dither within the same data selection period, whereby the transmission level of each subelement is determined by the data signal applied to the subelement in the data selection period in association with the strobe signal applied to the corresponding spatial dither bit.

* * * * *